US010383784B2

(12) United States Patent
Murphy et al.

(10) Patent No.: US 10,383,784 B2
(45) Date of Patent: Aug. 20, 2019

(54) GAIT TRAINING SYSTEM AND METHODS

(71) Applicant: Northeastern University, Boston, MA (US)

(72) Inventors: Patrick Murphy, Boston, MA (US); Michelle Cleary, Boston, MA (US); Shawn Gelsinger, Boston, MA (US); Melanie Jessel, Boston, MA (US); Steven McKanas, Boston, MA (US); Robert Struble, Boston, MA (US); Maciej Pietrusinski, Boston, MA (US); Sheng-Che Yen, Boston, MA (US); Qingchao Kong, Boston, MA (US); Constantinos Mavroidis, Boston, MA (US)

(73) Assignee: Northeastern University, Boston, MA (US)

( * ) Notice: Subject to any disclaimer, the term of this patent is extended or adjusted under 35 U.S.C. 154(b) by 866 days.

(21) Appl. No.: 14/907,064

(22) PCT Filed: Jul. 29, 2014

(86) PCT No.: PCT/US2014/048664

§ 371 (c)(1),
(2) Date: Jan. 22, 2016

(87) PCT Pub. No.: WO2015/017435

PCT Pub. Date: Feb. 5, 2015

(65) Prior Publication Data

US 2016/0166460 A1 Jun. 16, 2016

Related U.S. Application Data

(60) Provisional application No. 61/910,644, filed on Dec. 2, 2013, provisional application No. 61/860,037, filed on Jul. 30, 2013.

(51) Int. Cl.
*A61H 1/00* (2006.01)
*A61H 1/02* (2006.01)
(Continued)

(52) U.S. Cl.
CPC ..... *A61H 1/0262* (2013.01); *A61H 1/0255* (2013.01); *A61H 3/04* (2013.01);
(Continued)

(58) Field of Classification Search
CPC ..... A61H 1/0262; A61H 1/0255; A61H 3/04; A61H 3/008; A61H 2003/007;
(Continued)

(56) References Cited

U.S. PATENT DOCUMENTS 9,713,439 B1 * 7/2017 Wu ..... A61B 5/112
2008/0234113 A1 * 9/2008 Einav ..... A61B 5/103 482/66

(Continued)

FOREIGN PATENT DOCUMENTS

WO WO 2012/049442 A1 4/2012
WO WO 2012/178171 A2 12/2012

(Continued)

OTHER PUBLICATIONS

International Preliminary Report on Patentability from PCT/US2014/048664, dated Feb. 11, 2016.

(Continued)

*Primary Examiner* — Steven O Douglas
(74) *Attorney, Agent, or Firm* — Hamilton, Brook, Smith & Reynolds, P.C.

(57) ABSTRACT

Systems, methods and components of a joint actuating gait training system are provided. The gait training system includes a base support frame and an upper flexion actuation
(Continued)

assembly movably coupled to the base support frame and a lower flexion actuation assembly movably coupled to the base support frame.

22 Claims, 19 Drawing Sheets

(51) Int. Cl.

| | |
|---|---|
| ***A63B 69/00*** | (2006.01) |
| ***A61H 3/04*** | (2006.01) |
| ***A63B 21/00*** | (2006.01) |
| ***A63B 21/005*** | (2006.01) |
| ***A63B 21/068*** | (2006.01) |
| ***A63B 22/20*** | (2006.01) |
| ***A63B 24/00*** | (2006.01) |
| ***A63B 22/02*** | (2006.01) |
| ***A63B 23/04*** | (2006.01) |
| *A61H 3/00* | (2006.01) |
| *A63B 22/00* | (2006.01) |

(52) U.S. Cl.

CPC ..... *A63B 21/0004* (2013.01); *A63B 21/0058* (2013.01); *A63B 21/00178* (2013.01); *A63B 21/00181* (2013.01); *A63B 21/068* (2013.01); *A63B 21/4011* (2015.10); *A63B 21/4015* (2015.10); *A63B 22/02* (2013.01); *A63B 22/20* (2013.01); *A63B 23/0405* (2013.01); *A63B 24/0006* (2013.01); *A63B 24/0087* (2013.01); *A63B 69/0064* (2013.01); *A61H 3/008* (2013.01); *A61H 2003/007* (2013.01); *A61H 2201/1215* (2013.01); *A61H 2201/1238* (2013.01); *A61H 2201/5064* (2013.01); *A61H 2201/5069* (2013.01); *A61H 2201/5079* (2013.01); *A61H 2201/5084* (2013.01); *A61H 2201/5092* (2013.01); *A63B 22/0235* (2013.01); *A63B 2022/0094* (2013.01); *A63B 2024/0012* (2013.01); *A63B 2024/0093* (2013.01); *A63B 2220/10* (2013.01); *A63B 2220/16* (2013.01); *A63B 2220/30* (2013.01); *A63B 2220/40* (2013.01); *A63B 2220/51* (2013.01); *A63B 2220/805* (2013.01); *A63B 2220/806* (2013.01); *A63B 2220/807* (2013.01); *A63B 2220/89* (2013.01)

(58) Field of Classification Search

CPC .... A61H 2201/1215; A61H 2201/1238; A61H 2201/5064; A61H 2201/5069; A61H 2201/5079; A61H 2201/5084; A61H 2201/5092; A63B 21/4011; A63B 21/4015; A63B 21/0004; A63B 21/00178; A63B 21/00181; A63B 21/0058; A63B 21/068; A63B 22/02; A63B 22/20; A63B 23/0405; A63B 24/0006; A63B 24/0087; A63B 69/0064; A63B 22/0235; A63B 2022/0094; A63B 2024/0012; A63B 2024/0093; A63B 2220/10; A63B 2220/16; A63B 2220/30; A63B 2220/40; A63B 2220/51; A63B 2220/805; A63B 2220/806; A63B 2220/807; A63B 2220/89

See application file for complete search history.

(56) References Cited

U.S. PATENT DOCUMENTS

| | | | | |
|---|---|---|---|---|
| 2012/0046578 | A1 | 2/2012 | Agrawal et al. | |
| 2013/0226048 | A1* | 8/2013 | Unluhisarcikli ..... | A61H 3/00 601/34 |
| 2014/0213951 | A1* | 7/2014 | Pietrusisnki ..... | A61H 1/024 602/23 |

FOREIGN PATENT DOCUMENTS

| | | | |
|---|---|---|---|
| WO | WO 2013/049658 | A1 | 4/2013 |
| WO | WO 2013/086035 | A1 | 6/2013 |

OTHER PUBLICATIONS

Notification of Transmittal of the International Search Report and the Written Opinion of the International Searching Authority, or the Declaration from PCT/US0214/048664, dated Nov. 14, 2014.

* cited by examiner

GAIT TRAINING SYSTEM AND METHODS

CROSS REFERENCE TO RELATED APPLICATIONS

This application is the U.S. National Stage of International Application No. PCT/US2014/048664, filed Jul. 29, 2014, which designates the U.S., published in English, and claims the benefit of U.S. Provisional Application No. 61/860,037, filed Jul. 30, 2013, entitled "Robotic Leg Advancement Device" and U.S. Provisional Application No. 61/910,644, filed Dec. 2, 2013, entitled "Joint Actuating Gait System". The entire teachings of the above applications are incorporated herein by reference.

GOVERNMENT SUPPORT

This invention was made with government support under Grant Number 1334092 from the National Science Foundation. The government has certain rights in the invention.

TECHNICAL FIELD

The present application relates generally to the field of gait training systems.

BACKGROUND

The upright, bipedal gait of humans is an intricate process that requires significant neurological intervention. In order to initiate and maintain gait, the locomotor centers in the brain must constantly integrate signals from various other parts of the brain. The complex neurological processes initiate the intricate movements of the lower limbs in order to initiate and maintain the gait cycle of both legs.

Strokes, spinal cord injuries, chronic pain, head injuries, orthopedic problems, cerebral palsy and multiple sclerosis are known to cause motor control related disabilities that impact gait kinematics and control. Traumatic events such as strokes often cause physical disability in adults exhibited as hemiparesis, a weakening in one side of the body that cause diminished balance, difficulty with mobility, muscle fatigue, and lack of coordination. As such, the gait of stroke patients and patients suffering from the aforementioned conditions or other similar conditions may be adversely impacted and may implicate significant physical therapy.

Various gait training paradigms rely on manual leg advancement, where physical therapists help a patient take their legs through the proper motion during ambulation over a treadmill, or over ground. Such manual therapy is a physically demanding task generally warranting the assistance of two or three assistive personnel.

SUMMARY

Various embodiments disclosed herein provide gait training systems and methods. Particular embodiments provide a gait training system that includes a base support frame and a hip flexion actuation assembly movably coupled to the base support frame and a knee flexion actuation assembly movably coupled to the base support frame. The knee flexion actuation assembly is movably coupled to the base support frame so as to move with respect to the base support frame independent of the hip flexion actuation assembly The hip flexion assembly includes a hip flexion actuator, a hip flexion linkage movably coupled to the hip flexion actuator for linear actuation. The knee flexion actuation assembly includes a knee flexion actuator and a knee flexion linkage movably coupled to the knee flexion actuator for linear actuation. The gait training system further includes a gait deviation module configured to determine a difference between a model gait and an input gait received via the hip flexion linkage and the knee flexion linkage and a gait actuator controller communicably coupled to the gait deviation module, the hip flexion actuator, and the knee flexion actuator. The gait actuator controller is configured to activate one or more of the hip flexion actuator and the knee flexion actuator in response to the difference between the model gait and the input gait to compensate for the difference between the model gait and the input gait by linear actuation of one or more of the hip flexion linkage and the knee flexion linkage.

In particular embodiments, the hip flexion actuator includes a first rotary motor coupled to a first capstan drum and the knee flexion actuator includes a second rotary motor coupled to a second capstan drum. The gait training system includes a first cable coupling the first capstan drum to the hip flexion linkage and a second cable coupling the second capstan drum to the knee flexion linkage, in accordance with particular embodiments. The knee flexion linkage is movably coupled to the knee flexion actuator via a first series elastic assembly, in accordance with particular embodiments. The first series elastic assembly includes at least one first spring positioned between the knee flexion actuator and the knee flexion linkage. The hip flexion linkage is movably coupled to the hip flexion actuator via a second series elastic assembly, in accordance with particular embodiments. The second series elastic assembly includes at least one second spring positioned between the hip flexion actuator and the hip flexion linkage. The gait deviation module may be configured to determine the difference based on a deflection of at least one of the at least one first spring and the at least one second spring. In particular embodiments, the first series elastic assembly includes a distal spring coupled to distal end of the knee flexion linkage and a proximal spring coupled to a proximal end of the knee flexion linkage. The distal spring and the proximal spring are coupled to a cable wrapped about the second capstan drum. In particular embodiments, the first series elastic assembly includes a first spring and a second spring coupled to the knee flexion linkage. The first spring is coupled to a pulley component by a first cable. The second spring is coupled to a second cable coupled to a leg brace. In particular embodiments, the difference includes a position value corresponding to a position and a velocity value corresponding to a velocity. The gait deviation module is configured to determine the difference by an impedance measurement value, in accordance with particular embodiments. The knee flexion actuation assembly is rotatably coupled to the base support frame and the hip flexion actuation assembly is rotatably coupled to the base support frame independent of the knee flexion actuation assembly, in accordance with particular embodiments. The knee flexion actuation assembly may be rotatably coupled to the base support frame via a turntable. The knee flexion actuation assembly includes an alignment bracket comprising a plurality of rollers where the knee flexion linkage extending between the plurality of rollers, in accordance with particular embodiments. The hip flexion actuation assembly may be movably coupled to the base support frame for yaw rotation with respect to the base support frame and for pitch rotation with respect to the base support frame. The hip flexion linkage and the knee flexion linkage may be coupled to a brace configured for attachment below the knee of a patient. The hip flexion linkage may include a brace coupling configured to rotate about a plurality of axes. The brace coupling couples the hip flexion linkage to a knee brace. In particular embodiments, the base frame includes a walker. The base frame may include a treadmill or a BWSS (body weight support system) as discussed in further detail herein .

Particular embodiments provide a gait training method. The method includes receiving, at a gait training controller, model gait values corresponding to parameters of a model gait. The method also includes detecting, via at least one sensor communicably coupled to the gait training controller, parameters of an input gait received via a knee flexion linkage coupled to a knee flexion actuator and a hip flexion linkage coupled to a hip flexion actuator, the knee flexion linkage coupled to the knee flexion actuator via a first series elastic assembly. The first series elastic assembly includes at least one first spring. The hip flexion linkage is coupled to the hip flexion actuator via a second series elastic assembly including at least one second spring. The method further includes determining a difference between the model gait and the input gait and activating one or more of the knee flexion actuator and the hip flexion actuator so as to compensate for the difference between the model gait and the input gait.

In particular embodiments, detecting includes sensing a change in a position of the knee flexion linkage and the hip flexion linkage. Determining a difference between the model gait and the input gait includes determining a force being applied to at least one of the at least one first spring and the at least one second spring, in accordance with particular embodiments. Activating one or more of the knee flexion actuator and the hip flexion actuator may include rotating a capstan drum.

Particular embodiments provide a gait training system including a base support frame, an upper flexion actuation assembly movably coupled to the base support frame, and a lower flexion actuation assembly movably coupled to the base support frame so as to move with respect to the base support frame independent of the upper flexion actuation assembly. The upper flexion assembly includes a first flexion actuator and a first flexion linkage movably coupled to the first flexion actuator for linear actuation. The lower flexion actuation assembly includes a second flexion actuator and a second flexion linkage movably coupled to the second flexion actuator for linear actuation. The gait training system also includes a leg brace coupled to the first flexion linkage the second flexion linkage by one or more series elastic assemblies. The one or more series elastic assemblies includes at least one spring component. The gait deviation module is configured to determine a difference between a model gait and an input gait received via the upper flexion linkage and the lower flexion linkage. The gait training system also includes and a gait actuator controller is communicably coupled to the gait deviation module, the upper flexion actuator, and the lower flexion actuator. The gait actuator controller is configured to activate one or more of the first flexion actuator and the second flexion actuator in response to the difference between the model gait and the input gait to compensate for the difference between the model gait and the input gait by linear actuation of one or more of the first flexion linkage and the second flexion linkage via the leg brace.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

The skilled artisan will understand that the drawing primarily is for illustrative purposes and is not intended to limit the scope of the inventive subject matter described herein. The drawing is not necessarily to scale; in some instances, various aspects of the inventive subject matter disclosed herein may be shown exaggerated or enlarged in the drawings to facilitate an understanding of different features. In the drawing, like reference characters generally refer to like features (e.g., functionally similar and/or structurally similar elements).

The features and advantages of the inventive concepts disclosed herein will become more apparent from the detailed description set forth below when taken in conjunction with the drawings.

DETAILED DESCRIPTION

Following below are more detailed descriptions of various concepts related to, and exemplary embodiments of, inventive systems, methods and components a joint actuating gait training system.

Figure 1:
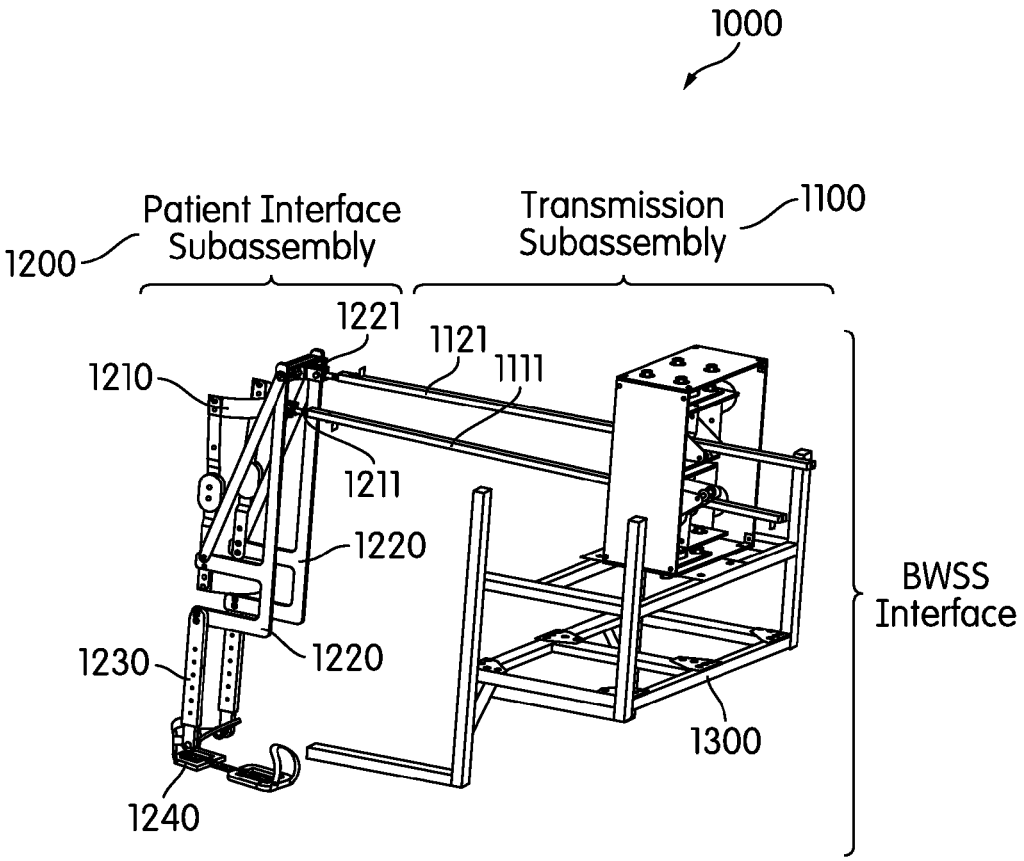
FIG. 1 is a perspective view of a joint actuating gait training system, in accordance with exemplary inventive embodiments.

FIG. 1 is a perspective view of a joint actuating gait training system, in accordance with exemplary inventive embodiments. Joint actuating gait training system 1000 includes a joint actuation assembly 1100 coupled to a patient interface subassembly 1200 and coupled to a body weight support system interface 1300. The joint actuating gait training system 1000 is configured for over ground training as well as training over a treadmill, in accordance with example embodiments. The body weight support system interface 1300 is configured for mounting the joint actuation assembly 1100 to a body weight support system, in accordance with example embodiments. In particular embodiments, the joint actuation assembly 1100 is coupled to a treadmill or walking assistance system, such as a walker for over ground gait training. The joint actuation assembly 1100 is coupled to the patient interface 1200 via linear linkages, namely a hip flexion linkage 1111 and a knee flexion linkage 1121. The patient interface subassembly 1200 includes a knee brace 1210 and a lever arm linkage 1220. Hip flexion linkage 1111 is coupled to the knee brace 1210 of the patient interface 1200 via a multi-axis rotating coupling, first clevis pin 1211. Similarly knee flexion linkage 1121 is coupled to the lever arm linkage 1220 via a multi-axis rotating coupling, a second clevis pin 1221. The patient interface subassembly 1200 further includes a height adjustable shank rail 1230 movably coupling a shoe attachment 1240 to the lever arm linkage 1230.

Figure 2:
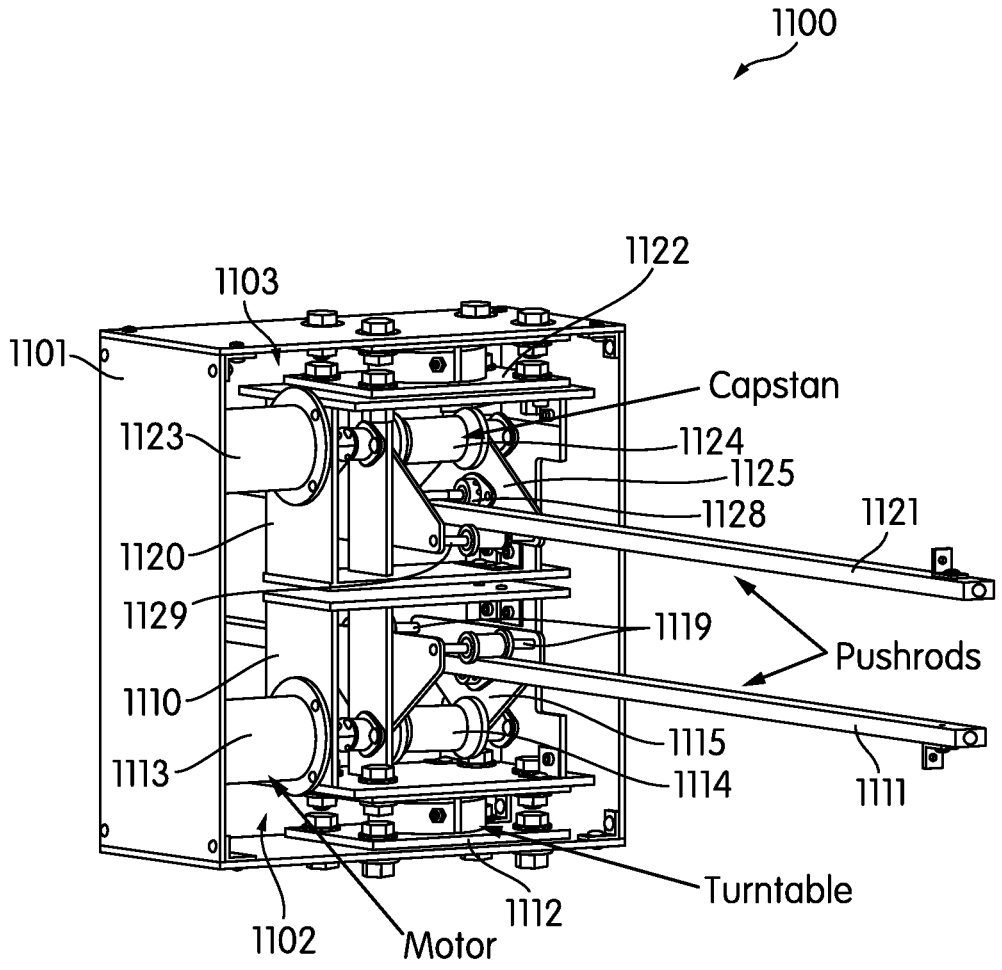
FIG. 2 is a perspective view of the actuation system of the joint actuating gait training system of FIG. 1.

FIG. 2 is a perspective view of the actuation system of the joint actuating gait training system of FIG. 1. The joint actuation assembly 1100 includes a base support frame 1101, a hip flexion actuation assembly 1110 and a knee flexion actuation assembly 1120 each coupled to the base support frame 1101. The hip flexion actuation assembly 1102 and the knee flexion actuation assembly 1103 respectively include a hip flexion actuation sub-frame 1110 and a knee flexion actuation sub-frame 1120, independently, movably coupled to the base support frame 1101 via turntables 1112 and 1122. The hip flexion actuation sub-frame 1110 and the knee flexion actuation sub-frame 1120 may be composed of steel. Each of the hip flexion actuation assembly 1120 and the knee flexion actuation assembly 1120 include a rotary actuator 1113 and 1123. The rotary actuators 1113 and 1123 are coupled to capstan rotors 1114 and 1124 which are used to linearly actuate the hip flexion linkage 1111 and the knee flexion linkage 1121. As discussed further herein, the rotary actuators 1113 and 1123 are independently controlled to compensate for differences between a model gait trajectory and gait inputs received via the hip flexion linkage 1111 and the knee flexion linkage 1121 by a patient coupled to the patient interface 1200 in response to detection of those differences. The hip flexion linkage 1111 and the knee flexion linkage 1121 transmit forces generated by rotary actuators 1113 and 1123 to the patient interface 1200 to flex and extend the knee and hip of a patient. The base support frame 1101 allows independent rotation of the hip flexion linkage 1111 and the knee flexion linkage 1121 therein via turntables 1112 and 1122. Alignment of the hip flexion linkage 1111 and the knee flexion linkage 1121 within the hip flexion actuation sub-frame 1110 and the knee flexion actuation sub-frame 1120 is assisted by alignment brackets 1115 and 1125. In example embodiments alignment brackets 1115 and 1125 may be movably coupled to the hip flexion actuation sub-frame 1110 and the knee flexion actuation sub-frame 1120. The alignment brackets 1115 and 1125 including a tracking roller 1118, 1128 and two guide rollers 1119, 1129. The guide rollers 1119, 1129 include smaller roller bearings in them that allow free rotation. The tracking roller 1118, 1128 provides a third point with respect to guide rollers 1119, 1129 to provide three point support so that the hip flexion linkage 1111 and the knee flexion linkage 1121 are in constant contact with the alignment brackets 1115 and 1125 respectively. The hip flexion linkage 1111 and the knee flexion linkage 1121 also include brackets 1130 and 1140 for coupling each of the linkages to the capstan drum rotors 1114 and 1124.

Figure 3:
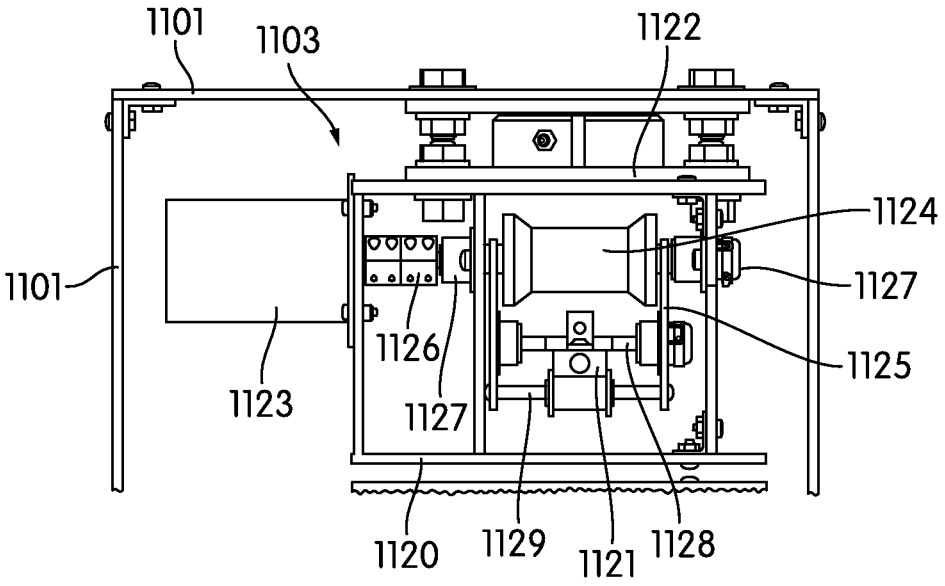
FIG. 3 is a front view of the actuation system of the joint actuating gait training system of FIG. 1.

FIG. 3 is a front partial view of the actuation system of the joint actuating gait training system of FIG. 1. FIG. 3 shows the knee flexion actuation assembly 1103 movably coupled to the base support frame 1101 via the knee flexion actuation sub-frame 1120. The rotary actuator 1123 is coupled to the knee flexion actuation sub-frame 1120 and is movable with respect to the base support frame 1101 thereby. The rotary actuator 1123 is coupled to the capstan drum rotor 1124 via couplings 1126. Capstan drum rotor 1124 is coupled to the knee flexion actuation sub-frame 1120 for rotation about the axis of the shaft of rotary actuator 1123 within the knee flexion actuation sub-frame 1120 pursuant to actuation of the rotary actuator 1123. Bearings 1127 may be provided to assist with rotation of the shaft of rotary actuator 1123 and the capstan drum rotor 1124 with respect to the knee flexion actuation sub-frame 1120, by reducing friction between the components. As discussed further herein, the capstan drum rotor 1124 is coupled to knee flexion linkage 1121, such that rotary actuation of the capstan drum rotor 1124 linearly actuates the knee flexion linkage 1121 to move in a direction having a component orthogonal to the shaft of the rotary actuator 1123 (into and out of the page).

Figure 4:
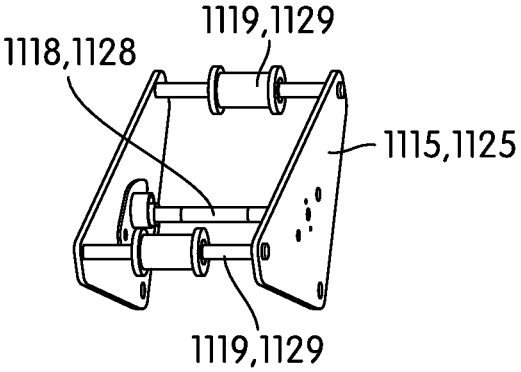
FIG. 4 shows an alignment bracket of the actuation system of FIG. 2.

FIG. 4 shows the alignment bracket of the actuation system of FIG. 2. The alignment bracket 1115, 1125 includes the tracking roller 1118, 1128 and two guide rollers 1119, 1129. In particular embodiments, the tracking roller 1118, 1128 is configured to track the linear displacement of the hip flexion linkage 1111 and the knee flexion linkage 1121. The tracking roller 1118, 1128 includes a rotary encode mounted to the end of the shaft to track rotation motion of the tracking roller 1119, 1128 in accordance with particular embodiments. The rotation of the tracking roller 1119, 1128 is converted into linear displacement of the hip flexion linkage 1111 and the knee flexion linkage 1121. In example embodiments, the hip flexion linkage 1111 and 1121 include a round linkage bar and the alignment bracket 1115, 1125 is configured to maintain alignment of the round linkage bar. In example embodiments, the alignment bracket 1115, 1125 includes an alignment sleeve having a shape corresponding to the shape of the hip flexion linkage 1111 and 1120.

Figure 5:
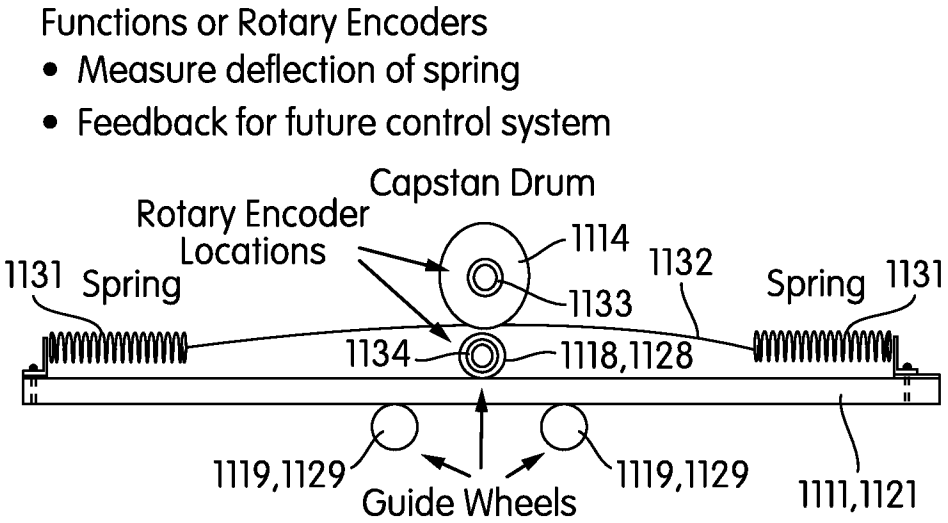
FIG. 5 is a schematic of a series elastic system of the joint actuating gait training system of FIG. 1.

FIG. 5 is a schematic of a series elastic system of the joint actuating gait training system of FIG. 1. The hip flexion linkage 1111 and the knee flexion linkage 1121 are respectively coupled to the capstan rotors 1114 and 1124 of the rotary actuators 1113 and 1123 via a series elastic assembly, including a spring 1131 coupled to the capstan rotor. In the illustrated embodiment, the linkage 1110, 1120 includes a spring 1131 coupled at each end of the linkage 1110, 1120. The springs 1131 are coupled to a cable 1132 wrapped about the capstan rotor 1114, 1124. When compressed, the spring constant and amount of spring deflection measured can be used by a control system to calculate the force being applied to the spring (or by the spring). As demonstrated in the example embodiments, the deflection may be determined by sensors, such as rotary encoder 1133 in the capstan rotor 1114, 1124 and a rotary encoder 1134 in the tracking roller 1118, 1128. The springs 1131 accommodate small timing differences introduced into the system so that the control system can sense the amount of deflection present, and either applies more or less force as necessary. In particular embodiments, the spring constant of 3.6 kN/m (2655 lb·ft.) was provided.

In accordance with particular embodiments, the difference between the rotary displacement of the capstan drum rotor 1114, 1124 and the linear displacement of the hip flexion linkage 1111 or the knee flexion linkage 1121, is used to determine the displacement of a spring positioned between the linkages 1110, 1120 in a series elastic system arrangement and the force exerted thereon.

Figure 6:
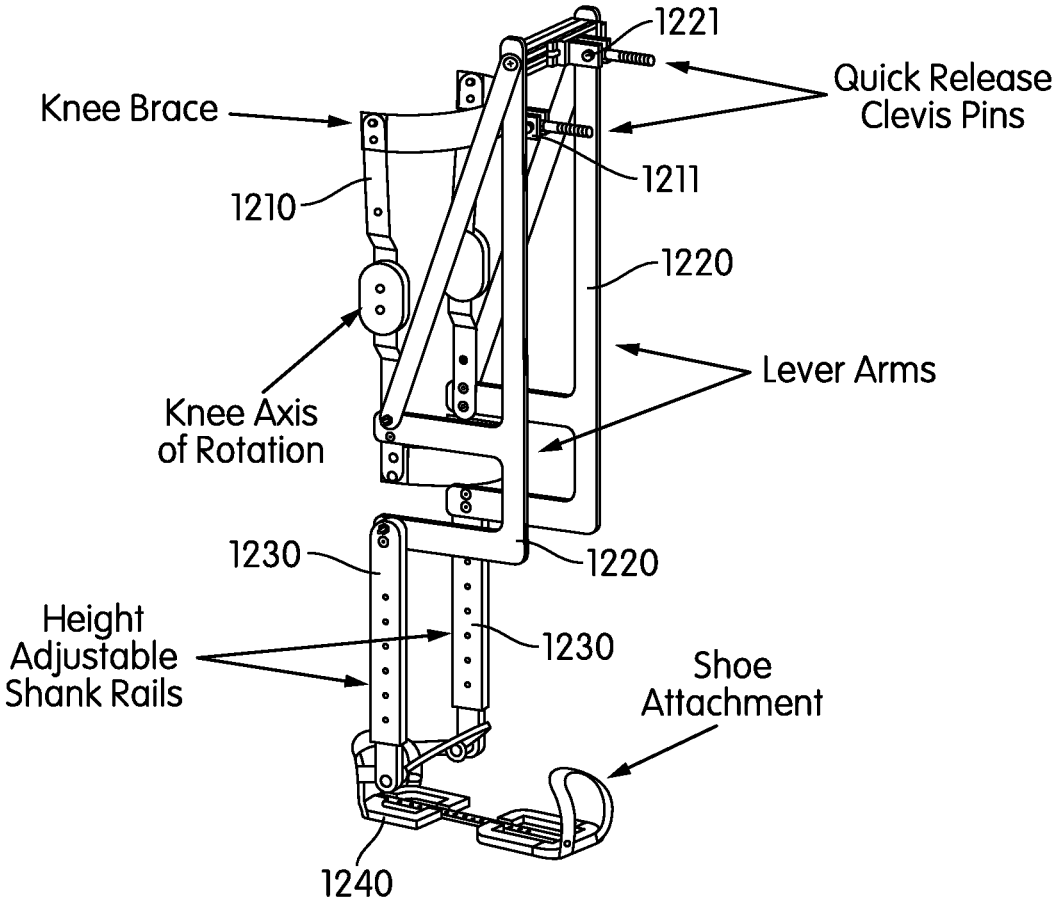
FIG. 6 is a patient interface system of the joint actuating gait training system of FIG.

FIG. 6 is a patient interface system of the joint actuating gait training system of FIG. 1. While example embodiments may include a direct linkage to the knee without a knee brace, the patient interface system 1200 includes a knee brace 1210 to rigidly transfer the forces of the hip flexion linkage 1111 and the knee flexion linkage 1121 generated by rotary actuators 1113 and 1123 to the leg of a patient coupled thereto. The patient interface 1200 also includes the lever arm linkage 1220. The lever arm linkage 1220 connects the knee flexion linkage 1121 to the patient leg below the knee to cause knee flexion while permitting the knee flexion linkage 1121 to apply a moment above the knee in accordance with particular embodiments. The lever arm linkage also attaches the shoe attachment 1240 via the height adjustable shank rail 1230. The height adjustable shank rail 1230 includes a telescopic rail configured to change the distance between the lever arm linkage 1220 and the shoe attachment 1240. The shoe attachment 1240 may be used to reduce migration and rotation of the knee brace along a longitudinal axis of the leg shank.

Figure 7:
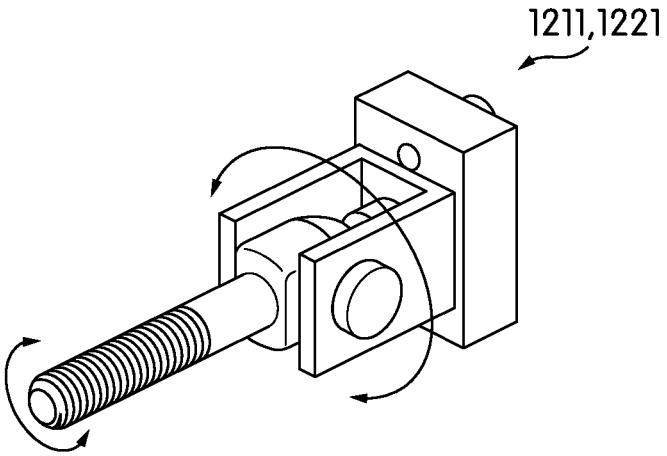
FIG. 7 illustrates coupling interface for the patient interface system of FIG. 6.

FIG. 7 illustrates coupling interface for the patient interface system of FIG. 6. The coupling interface includes the first clevis pin 1211 rotatably coupling the hip flexion linkage 1111 is to the knee brace 1210 of the patient interface 1200 for multi-axis rotation and the second clevis pin 1221 rotatably coupling the knee flexion linkage 1121 to the lever arm linkage 1220 of the patient interface 1200 also for multi-axis rotation.

Figure 8:
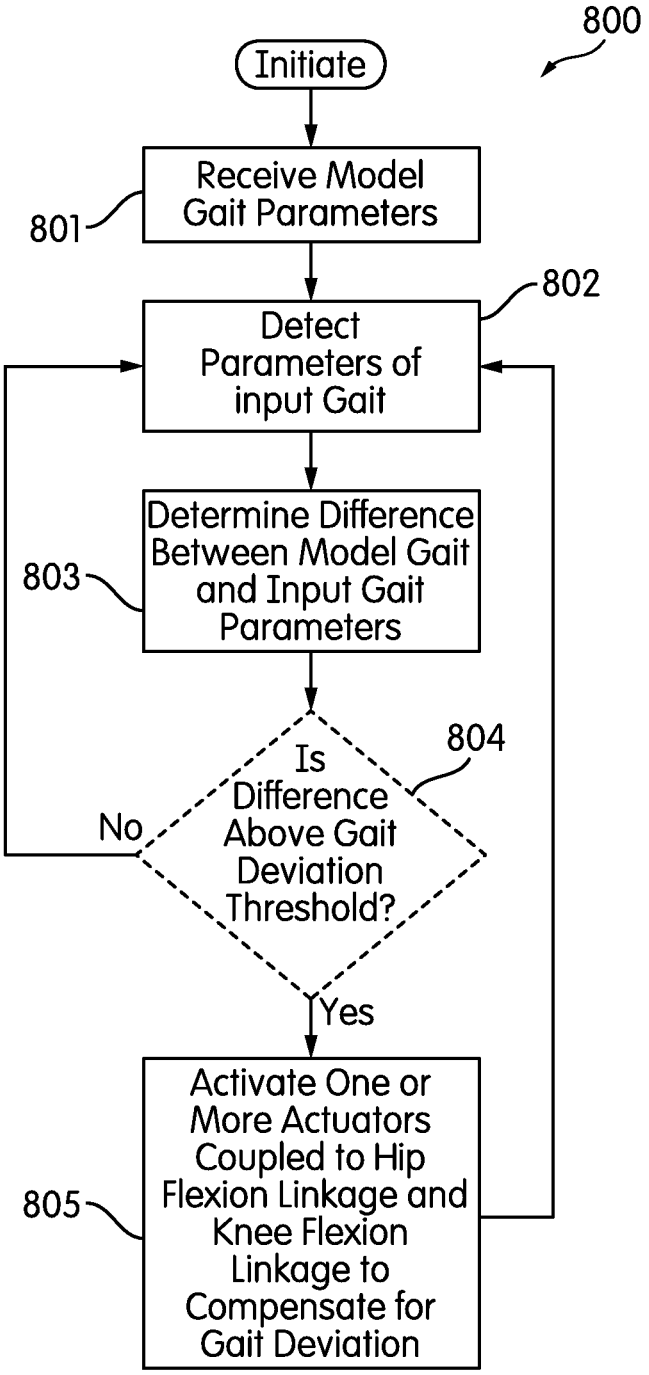
FIG. 8 is a flow diagram for a joint actuating gait training system, in accordance with exemplary inventive embodiments.

FIG. 8 is a flow diagram for a joint actuating gait training system, in accordance with exemplary inventive embodiments. In accordance with particular embodiments the joint actuating gait training control system 800 is back-drivable and configured to apply force in response to a determination of gait deviation. Accordingly, if a patient walks without gait deviations the joint actuating gait training control system 800 is configured to continue tracking the motion of the leg of a patient without applying any forces to the patient. The joint actuating gait training control system 800 receives values at process 801 corresponding to one or more parameters of a model gait. The values may correspond to a position parameter, a force parameter, a velocity parameter, a speed parameter, and an acceleration parameter. The parameters sensed are (1) interaction forces between the manipulator and the leg and (2) positions and velocities of both feet, either in the fore-aft direction only, or also including any other directions of motion, i.e. up and down or side to side. Position and velocity of the foot of the leg manipulated by the device can be measured using the linear and/or angular position sensors in the structure of the manipulators/actuators, and the position and velocity of the foot on the leg which isn't actuated can be measured with a variety of technologies such as string potentiometer, string encoder, or even non-contact methods such as distance measuring ultrasonic sensors, or video camera—based systems with image recognition or with video systems relying on reflective markers. The device can also be comprised of two manipulators, each manipulator intended to interface with each leg. In that case there may not be a need for separate position/velocity measurement beyond what the manipulators themselves provide. The parameters may be calibrated to the position of components of the joint actuation assembly 1100. At process 802, the joint actuating gait training control system 800 detects parameters of the input gait. The parameters of the input gait may be detected by one or more sensors positioned on components of the joint actuation assembly 1100. For example, the rotary actuators 1113, 1123 may include a position sensor configured to detect a rotary position or a change in a rotary position of a sensor and may include one or more timers. The knee flexion linkage 1121 and the hip flexion linkage 1111 may include one or more sensors, including but not limited to a position sensor, an accelerometer, a potentiometer, a force sensor, an optical sensor, or other sensor used to determine one or more of position, velocity, acceleration, and force. The joint actuating gait training control system 800 includes a gait deviation module configured to determine at process 803 a difference between the model gait obtained in process 801 and an input gait received via the hip flexion linkage 1111 and the knee flexion linkage 1121 in process 802. In example embodiments, a motion caption camera is used to detect an input gait. The joint actuating gait training control system 800 analyzes the difference between the model gait and the input gait in analysis 804. In example embodiments, in response to a determination that the input gait is different than the model gait, the join actuating gait controller 800, which is communicably coupled to the rotary actuators of the joint actuation assembly, causes, at process 805 one or more of the rotary actuators coupled to the hip flexion linkage 1111 and the knee flexion linkage 1121 to actuate the flexion linkages based on the determined difference between the model gait and the input gait. The actuation of the hip flexion linkage 1111 and the knee flexion linkage 1121 are proportionate to the difference in the model gait and the input gait and are determined to compensate for the difference in the model gait and the input gait to correct the input gait to substantially correspond to the model gait. In particular embodiments, the system may be configured to apply forces in response deviations higher than a threshold amount or percentage. For example, the analysis process 804 may actuate for differences between the model gait and the input gait that exceed 0.1%

For certain modes of operation (in terms of how the device is used by the physical therapist or other individual) the control system obtains input gait kinematics from the user/patient, such as through the positions and velocities of the patients feet or joint angles and angular velocities, or translations and rotations of the leg segments (i.e. thigh and lower legs). The flexion actuation assemblies may be used to measure gait kinematics of the lower leg to which that actuation assembly is attached, because the actuation assembly generally already contains position sensors (e.g. series elastic assemblies) implemented for operation of the actuation assembly. In the case of joint actuating gait training system embodiments which are intended to only control one leg (and include only a pair of flexion actuation assemblies instead of 4 flexion actuation assemblies), another means of measuring gait kinematics of the non-actuated leg are employed, such as such as string potentiometer, string encoder, or even non-contact methods such as distance measuring ultrasonic sensors, or video camera.

In certain embodiments, the joint actuating gait training control system 800 further includes a controller structured to perform certain operations to determine differences between a model gait and an input gait and to activate and actuate the hip flexion actuator and the knee flexion actuator. In certain embodiments, the controller forms a portion of a processing subsystem including one or more computing devices having memory, processing, and communication hardware. The controller may be a single device or a distributed device, and the functions of the controller may be performed by hardware and/or as computer instructions on a non-transient computer readable storage medium.

In certain embodiments, the controller includes one or more modules structured to functionally execute the operations of the controller. In certain embodiments, the controller includes a gait deviation module, a gait actuator controller, and sensor modules, including but not limited to position and velocity sensors. The description herein including modules emphasizes the structural independence of the aspects of the controller, and illustrates one grouping of operations and responsibilities of the controller. Other groupings that execute similar overall operations are understood within the scope of the present application. Modules may be implemented in hardware and/or as computer instructions on a non-transient computer readable storage medium, and modules may be distributed across various hardware or computer based components. More specific descriptions of certain embodiments of controller operations are included in the section referencing FIG. 8.

Example and non-limiting module implementation elements include sensors providing any value determined herein, sensors providing any value that is a precursor to a value determined herein, datalink and/or network hardware including communication chips, oscillating crystals, communication links, cables, twisted pair wiring, coaxial wiring, shielded wiring, transmitters, receivers, and/or transceivers, logic circuits, hard-wired logic circuits, reconfigurable logic circuits in a particular non-transient state configured according to the module specification, any actuator including at least an electrical, hydraulic, or pneumatic actuator, a solenoid, an op-amp, analog control elements (springs, filters, integrators, adders, dividers, gain elements), and/or digital control elements.

Figure 9:
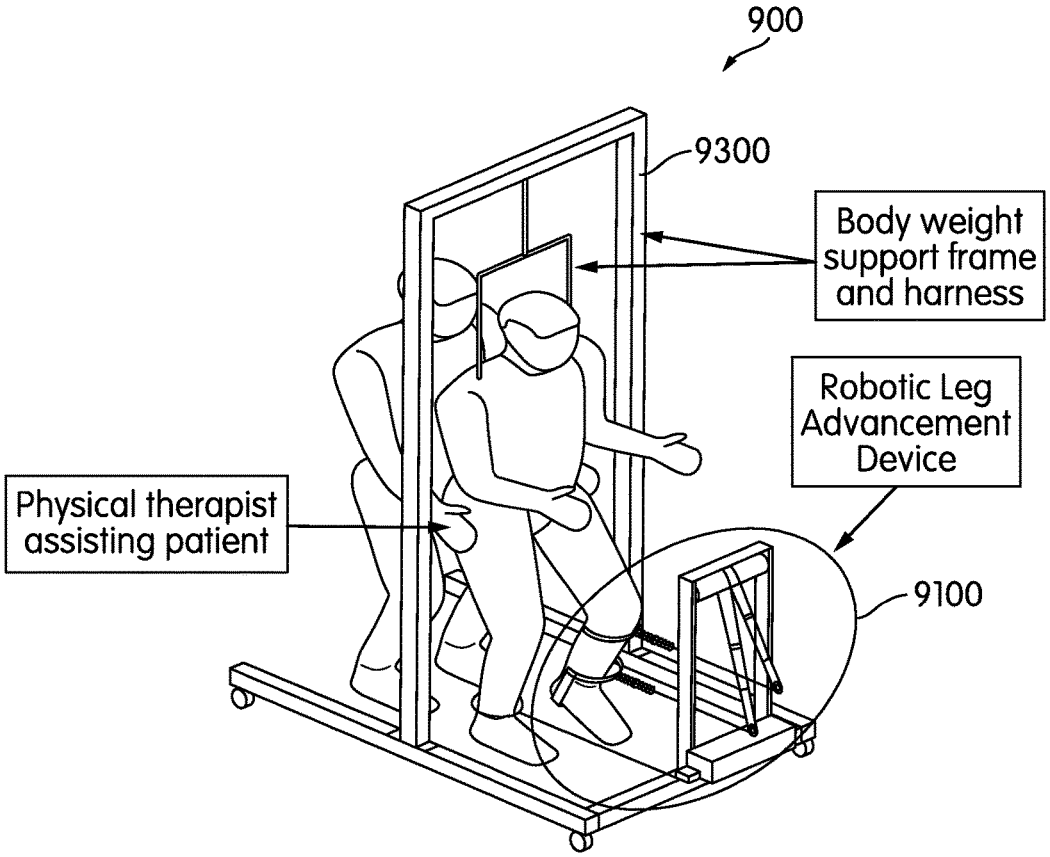
FIG. 9 illustrates a joint actuating gait training system coupled to a body weight support frame, in accordance with exemplary inventive embodiments.

FIG. 9 illustrates a joint actuating gait training system coupled to a body weight support frame, in accordance with exemplary inventive embodiments. Joint actuating gait training system 9000 includes a joint actuation assembly 9100 coupled to a body weight support frame and harness 9300.

Figure 10:
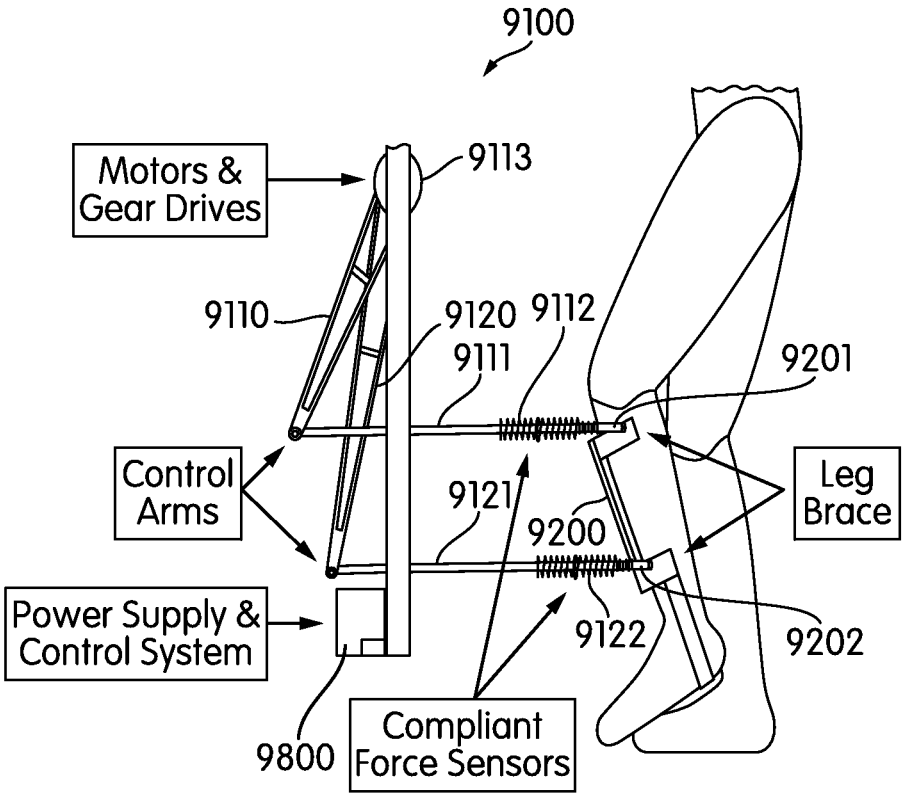
FIG. 10 provides a side view of the joint actuating gait training system of FIG. 9

FIG. 10 provides a side view of the joint actuating gait training system of FIG. 9. The joint actuation assembly 9100 includes one or more actuators 9113 configured to rotate hip flexion control arm 9110 and knee flexion control arm 9120 independent of one another. The hip flexion control arm 9111 and the knee flexion control arm 9121 are coupled to a hip flexion linkage 9110 and a knee flexion linkage 9120. The hip flexion linkage 9110 and the knee flexion linkage 9120 include compliant forces sensors 9112 and 9122 coupling the hip flexion linkage 9110 and the knee flexion linkage 9120 to leg brace 9200 at hip flexion attachment interface 9201 and knee flexion attachment interface 9202. The leg brace 1200 is configured with the hip flexion attachment interface 9201 positioned above the knee flexion attachment interface 9202. Although the hip flexion control arm 9110 is configured to couple to the leg brace on the lower portion of the leg below the knee the hip flexion control arm works in unison with the knee flexion control arm 9120 to achieve knee flexion. Specifically, the hip flexion control arm 9110 and the knee flexion control arm interface with the lower leg of a patient to cause lower leg rotation and forward-back translation, thereby causing hip and knee flexion and extension.

The joint actuation assembly 9100 includes a control system 9800, which may include a power supply. The control system 9800 is configured to determine deviations of an input gait from a model gait and actuate the one or more actuators 9113 in response to and based on the deviations of the input gait from the model gait. In particular embodiments, control system 9800 is configured to receive sensed measurements of a position and a velocity of the leg of a patient not coupled to the leg brace 9200.

Figure 11:
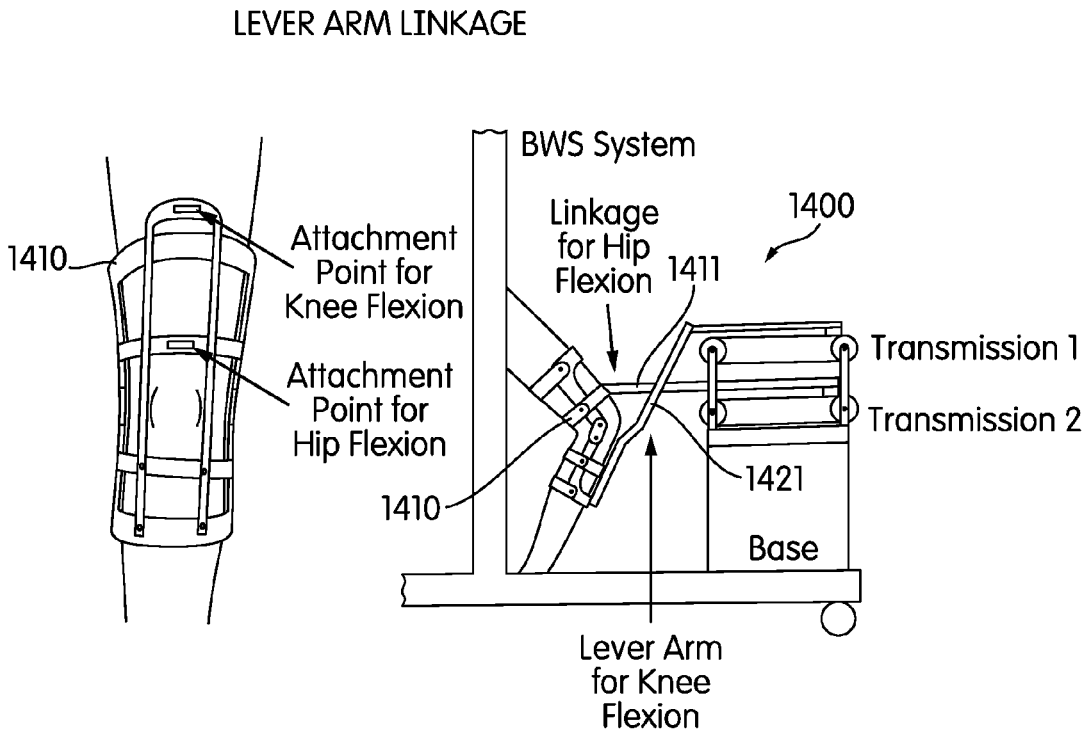
FIG. 11 illustrates a joint actuating gait training system including linkages configured to act above the knee, in accordance with exemplary inventive embodiments.

FIG. 11 illustrates a joint actuating gait training system including linkages configured to act above the knee, in accordance with exemplary inventive embodiments. Joint actuating gait training system 1400 provides a lever arm linkage embodiment that uses two linkages, a hip flexion linkage 1411 and a knee flexion linkage 1421, each controlled by a separate actuation system to distinctly actuate the knee joint and hip joint. The hip flexion linkage 1411 and the knee flexion linkage 1421 are configured to act above the knee via attachments to knee brace 1410. In accordance with the embodiment illustrated in FIG. 11, the placement of force application via hip flexion linkage 1411 and knee flexion linkage 1421 may be configured to produce equal and opposite forces on the leg about the knee so that the net effect on the patient is torque at the knee for knee flexion or extension with substantially no reaction force at the hip. In example embodiments, the hip flexion linkage and the knee flexion linkage may be positioned at the same height in order to facilitate providing equal and opposite forces on the patient leg.

Figure 12:
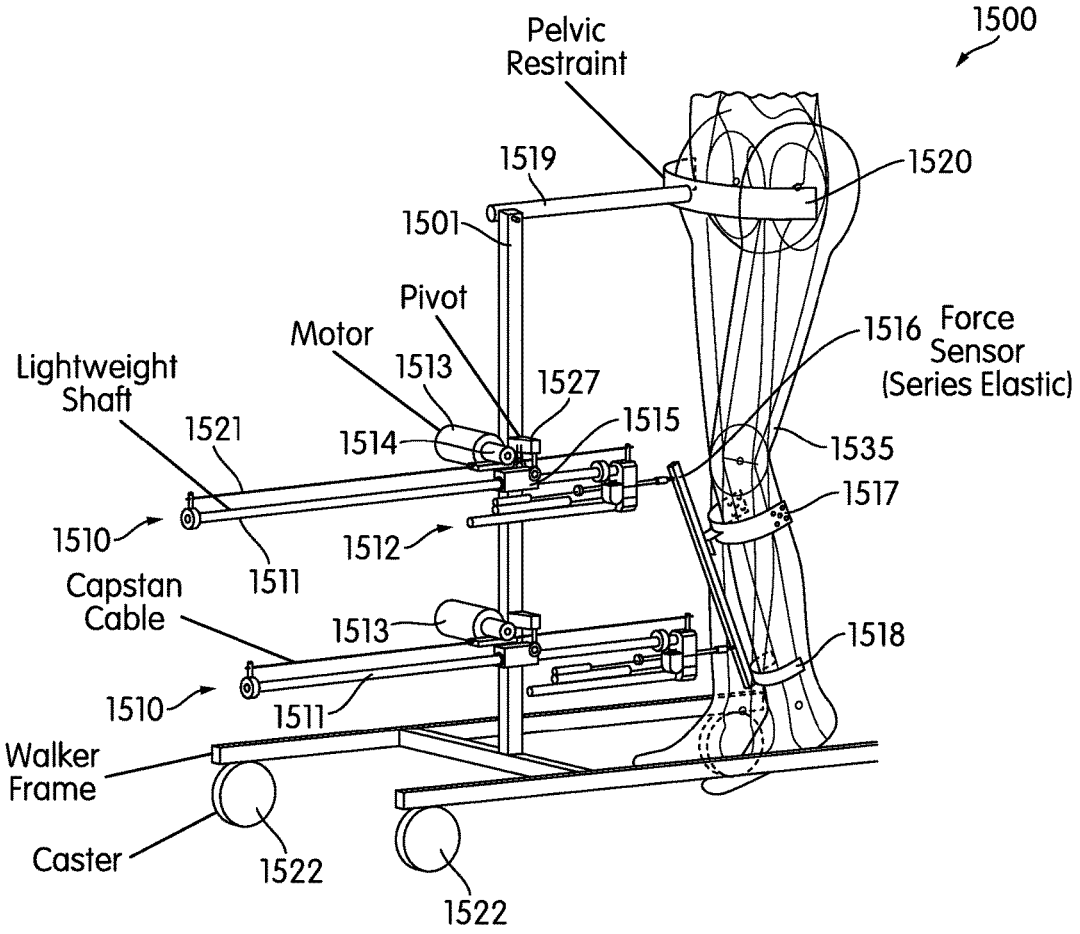
FIG. 12 shows a joint actuating gait training system coupled to walker frame, in accordance with exemplary inventive embodiments.

FIG. 12 shows a joint actuating gait training system coupled to walker frame, in accordance with exemplary inventive embodiments. Joint actuating gait training system 1500 includes a manipulator subassembly 1600 coupled to a walker frame 1501 including wheels 1522 permitting the walker frame to be rolled and permitting the joint actuating gait training system 1500 to be implemented in over ground gait training. The joint actuating gait training system 1500 includes a two flexion actuation assemblies 1510 coupled to the walker frame 1501 and positioned for knee flexion and hip flexion through leg brace 1516 and upper leg brace coupling 1517 and lower leg brace coupling 1518. The upper flexion actuation assembly translates the knee joint forward and back and the lower flexion actuation assembly translates the ankle forward and back. The combination of the forward and backward translation of the knee joint in combination with forward and backward translation of the ankle cause hip flexion/extension and knee flexion/extension.

In example embodiments, walker frame 1501 may include four flexion actuation assemblies 1510 configured to couple to two patient legs for hip and knee flexion of each leg. The flexion actuation assemblies 1510 include a sub-frame 1527 configured to movably couple the flexion actuation assemblies 1520 to the walker frame 1501. The flexion actuation assemblies 1510 include a flexion actuation linkage 1511, which is actuated in the illustrated embodiments via motor 1513. The flexion actuation linkage 1511 is a lightweight shaft component composed out of carbon fiber in example embodiments. The motor 1513 includes a rotary motor coupled to a capstan rotor 1514 via cable 1521. The motor 1513 is configured to actuate in a clockwise and counter-clockwise rotation as needed to move the flexion actuation linkage 1511 in a linear direction forward or rearward. The flexion actuation linkages 1511 are coupled to the leg brace 1516 at distinct locations configured to impart hip flexion and knee flexion. The joint actuating gait training system 1500 also includes a pelvic restraint 1520 coupled to the walker frame 1501 via support arm 1519. The pelvic restraint 1520 is configured to restrain the center of mass of a patient 1535. The flexion actuation assemblies 1510 also include a series elastic force sensor 1512 configured to sense force inputs from patient 1535 in connection with determining the required actuation forces required by the flexion actuation assemblies 1510 to correct the gait of the patient 1535.

Figure 13:
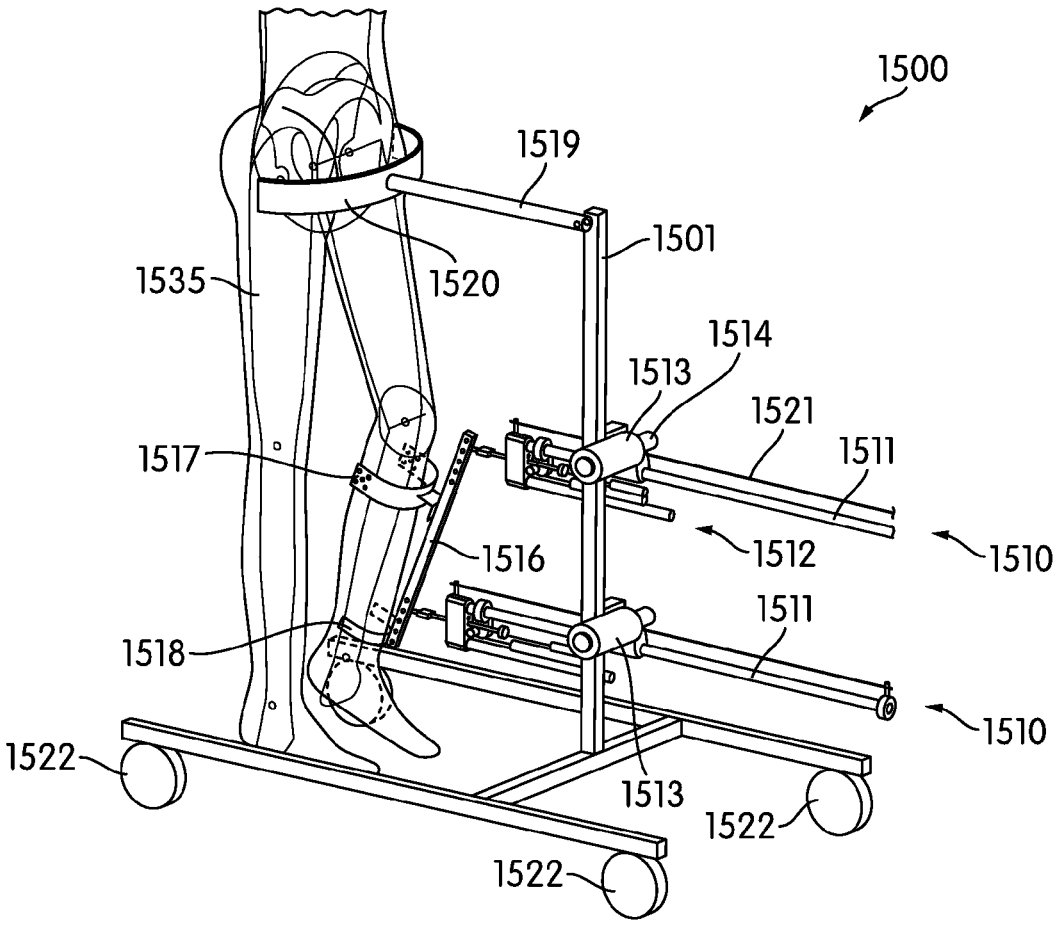
FIG. 13 shows the joint actuating gait training system of FIG. 12 from the opposite side, in accordance with exemplary inventive embodiments.

FIG. 13 shows the joint actuating gait training system 1500 of FIG. 12 from the opposite side of the walker frame 1501.

Figure 14:
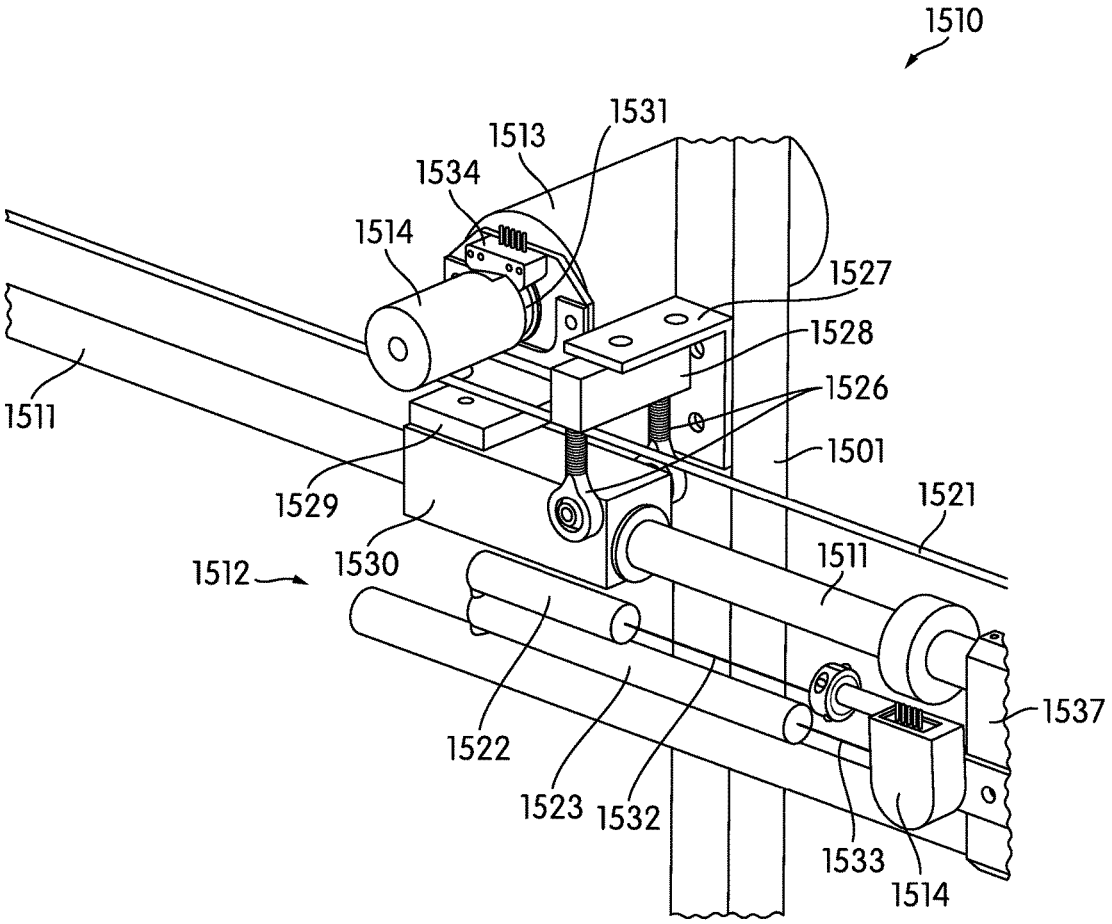
FIGS. 14 and 15 are magnified views of the flexion actuation assembly of the joint actuating gait training system of FIG. 12, in accordance with exemplary inventive embodiments.
Figure 15:
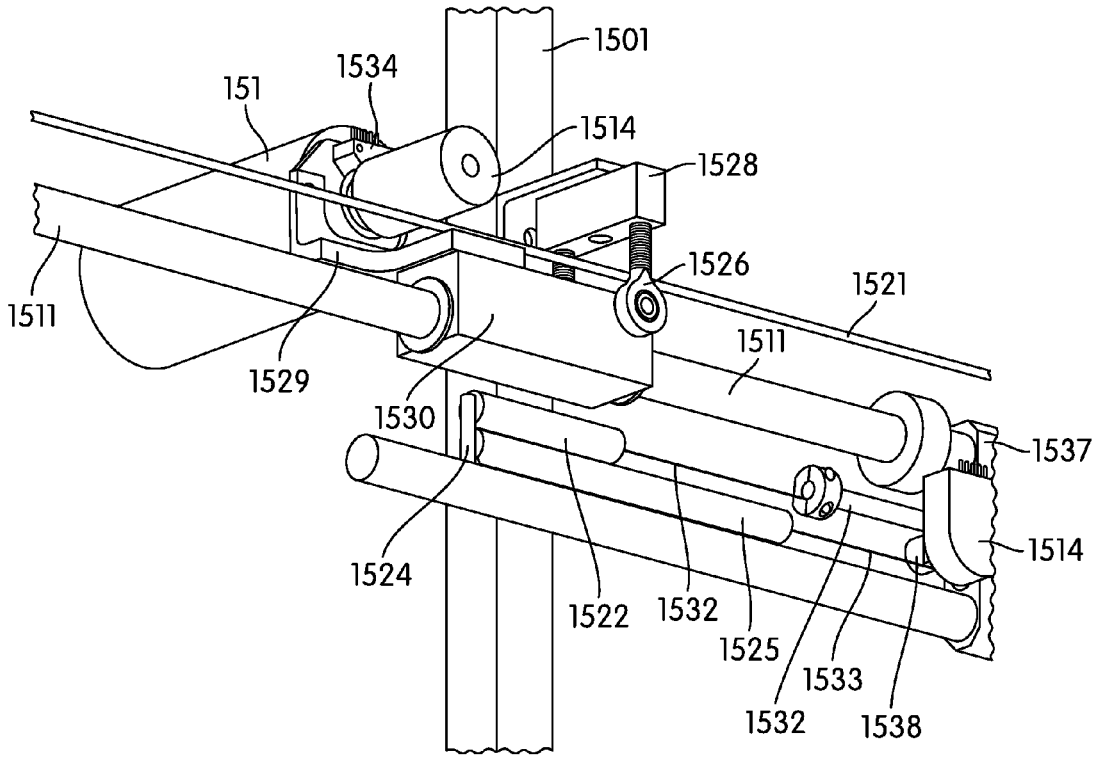

FIG. 14 is a magnified view of the flexion actuation assembly 1510 of the joint actuating gait training system 1500 of FIG. 12. The actuating component of the flexion actuation assembly 1510, namely rotary motor 1513, includes the capstan rotor 1514 coupled to the shaft of rotary motor 1513 via coupling 1531. A rotary encoder 1534 is also coupled to the shaft of the rotary motor 1513 to determine the rotations of the capstan rotor 1514 and thereby the extension of the flexion actuation linkage 1511. The rotary motor 1513 is coupled to linear bearing 1530 via motor mount 1529. The linear bearing 1530 facilitates linear actuation of the flexion actuation linkage 1511. The linear bearing 1530 is rotatably coupled to the sub-frame 1527 via rod ends 1526 and mounting block 1528. The rod ends 1526 are rotatably coupled to mounting block 1528 to rotate about the shaft of the rod ends. The linear bearing 1530 are configured to rotate about the eyelet of the rod ends 1526. Accordingly, the flexion actuation linkage 1511 and the rotary motor 1513 are configured for lateral rotation via the rod ends mounting in the mounting block 1528 and longitudinal rotation via the mounting blocks coupling to the rod ends The lateral and longitudinal rotation of the flexion actuation linkage permit patient movement.

In response to movement by the patient and forces input thereby, the flexion actuation assembly 1510 is configured to provide corrective feedback. The input force received from the patient is measured at the flexion actuation assembly 1510 via the series elastic force sensor 1512. The series elastic force sensor 1512 includes a first extension spring 1522 coupled to spring mount 1524 and a second extension spring 1523 also coupled to spring mount 1524. The first extension spring 1522 is coupled to a first extension cable 1532, which is coupled to force linkage 1536. The force linkage 1536 is slidably coupled to the flexion actuation assembly 1510 and is to slide in connector block 1537. The force linkage 1536 is coupled to the leg brace 1516 to receive forces from the patient. Forward extension of the patient legs causes the force linkage 1536 to slide forward thereby contracting the first extension spring 1522. The force linkage 1536 rotates on pulley 1538 as it slides through the connector block 1537. As the force linkage 1536 slides forward, pulley 1538 rotates. A second extension cable 1533 is coupled to the pulley 1538 and the second extension spring 1523. Accordingly, as the pulley 1538 rotates pursuant linkage force linkage sliding forward, the second extension cable 1533 winds around the pulley 1538 shortening its free length and causing the second extension spring 1523 to expand or stretch as the first extension spring contracts. The extension springs operate in revers as the force linkage 1536 slides in the opposite direction in response to the leg brace 1516 retracting as the patient 1535 moves their leg away from walker frame 1501. The series elastic force sensor 1512 includes a force sensor rotary encoder 1514 coupled to the pulley 1538 to measure the rotation of the pulley 1538 and thereby determine a change in spring extension and associated force exerted by patient 1535 The readings from the force sensor rotary encoder 1514 are sent to a controller, such as control system 800, for analysis.

Figure 16:
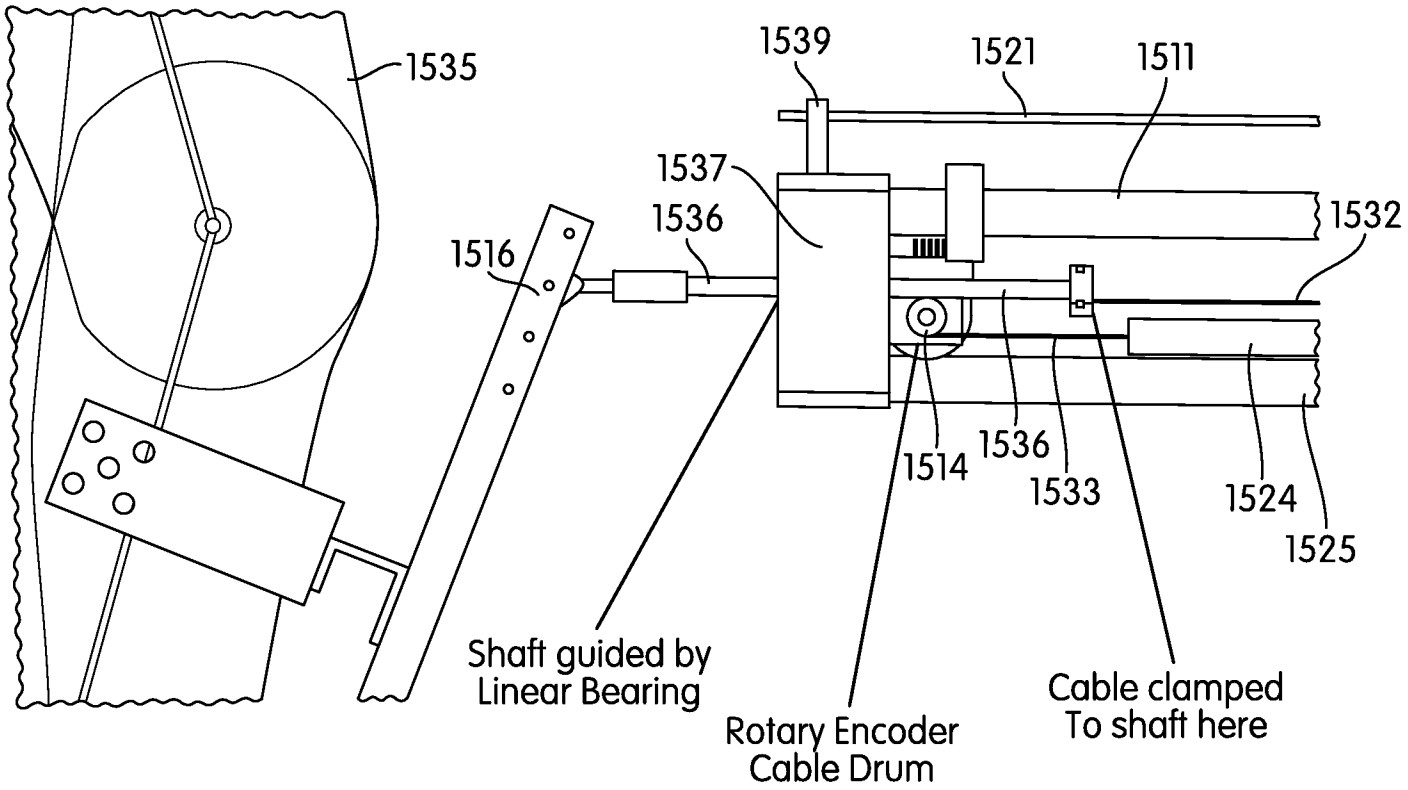
FIG. 16 is a magnified first side view of the flexion actuation assembly of the joint actuating gait training system of FIG. 12, in accordance with exemplary inventive embodiments.
Figure 17:
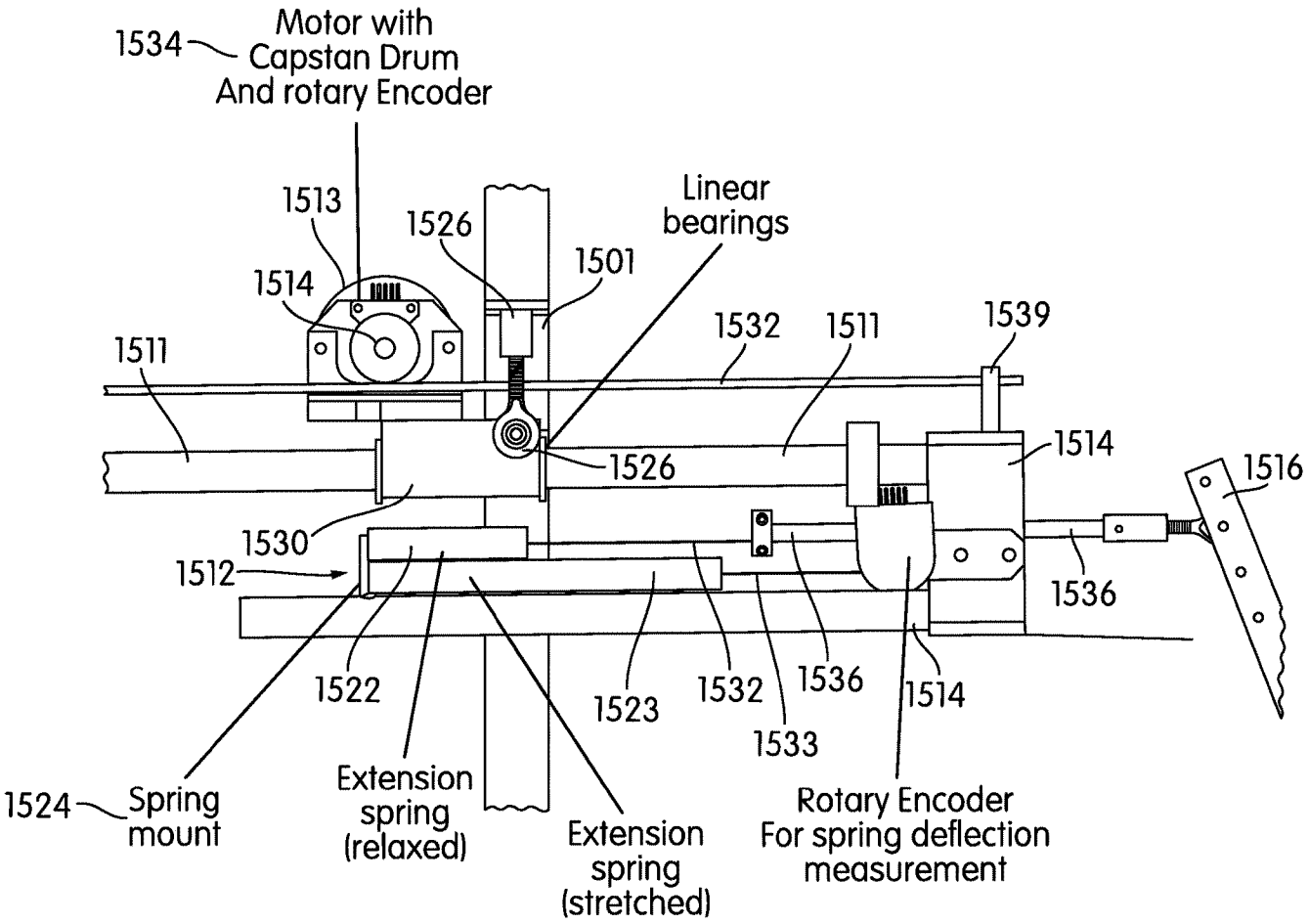
FIG. 17 is a magnified second side view of the flexion actuation assembly of the joint actuating gait training system of FIG. 12, in accordance with exemplary inventive embodiments.

FIG. 16 is a magnified first side view of the flexion actuation assembly 1510 of the joint actuating gait training system 1500 of FIG. 12. FIG. 17 is a magnified second side view of the flexion actuation assembly 1510 of the joint actuating gait training system 1500 of FIG. 12. As the first and second extension springs expand and contract, the flexion actuation linkage slides in the linear bearing 1530. The flexion actuation linkage receives force input by patient 1535 via the force linkage 1536. As the force linkage causes expansion and contraction of the first and second extension springs, the spring mount 1524 moves. The spring mount 1524 is rigidly coupled to the flexion actuation linkage 1511 via link 1525 and connector block 1537. Connector block 1537 also includes a cable post 1539 secured to a first end of cable 1521 coupled to and wrapped around capstan rotor 1514

Figure 18:
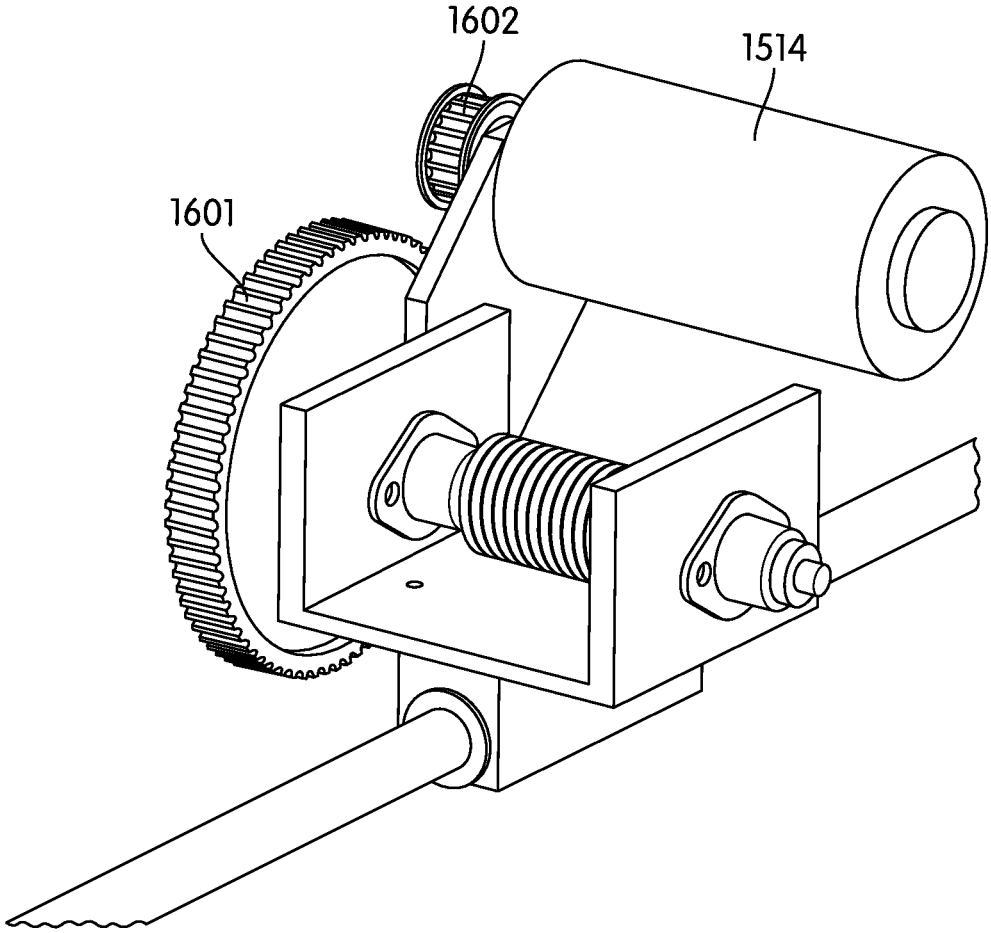
FIG. 18 is a magnified view of a coupling system for a capstan drum rotor, in accordance with exemplary inventive embodiments.
Figures 19A, 19B, 19C, 19D, 19E:
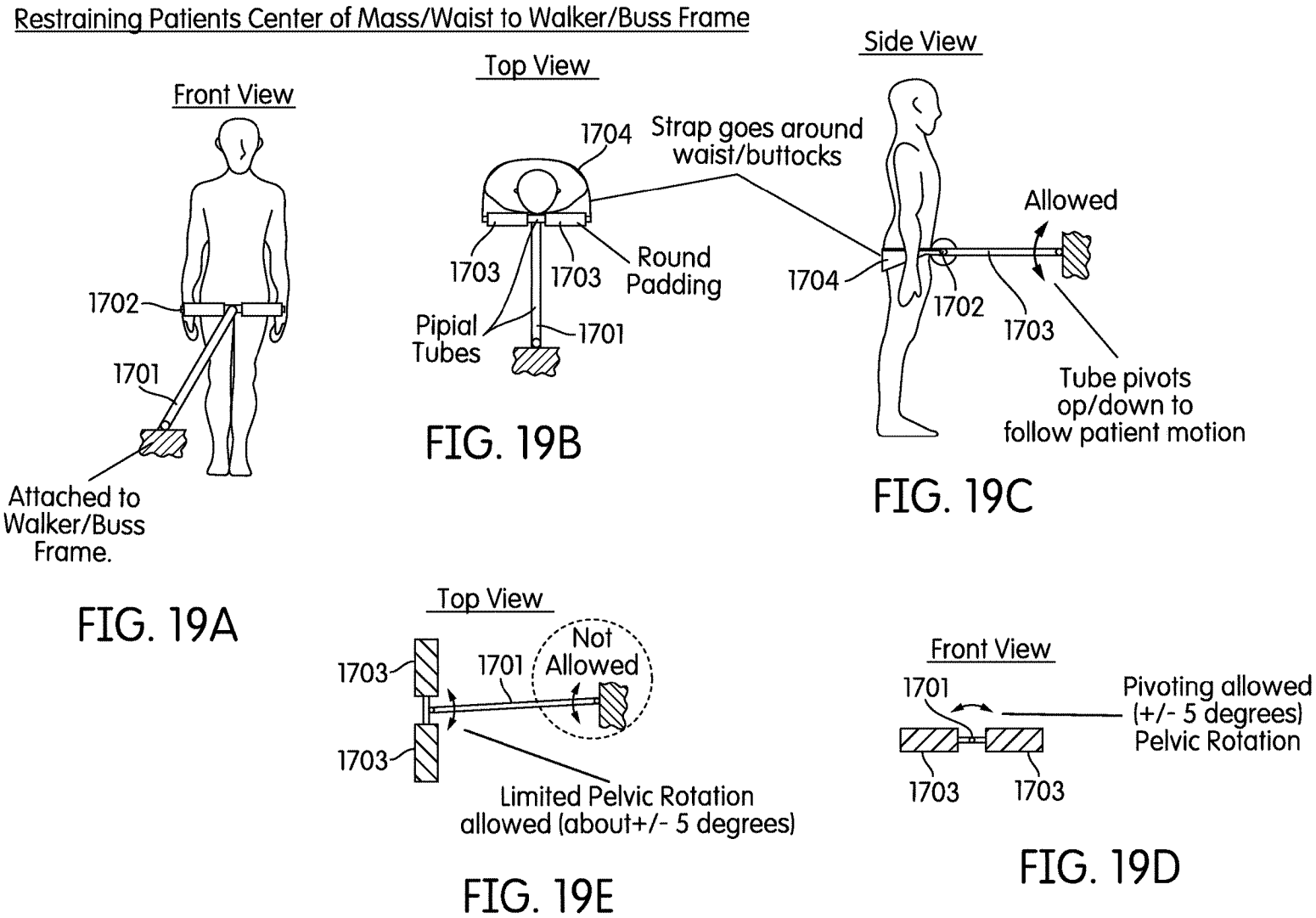
FIGS. 19A-19E illustrate a pelvic restraint system in accordance with exemplary inventive embodiments.

FIG. 18 is a magnified view of a coupling system for a capstan drum rotor. Various coupling configurations may be provided between an actuator and a capstan drum rotor in accordance with example embodiments disclosed herein. As illustrated in FIG. 17, in particular embodiments, the capstan drum rotor 1514 may be coupled to an actuator via a plurality of sprocket components, such as motor sprocket 1601 and rotor sprocket 1602. The motor sprocket 1601 and rotor sprocket 1602 may be synchronously coupled to one another via coupler including, but not limited to a timing belt or timing chain, in accordance with particular embodiments.

FIGS. 19A-19E illustrate a pelvic restraint system in accordance with exemplary inventive embodiments. The pelvic restrain system is configured to restrain the center of mass of a patient. The pelvic restrain 1700 may be coupled to a walker system or a body weight support system. The pelvic restraint 1700 includes a support arm 1701 coupled to a lateral front support bar 1702. The lateral front support bar 1702 includes padding tubes 1703. A strap 1704 extends from a first side to a second side of the lateral front support bar 1702 for extension around a patient as shown in the top view provided in FIG. 19B. As shown in the side view provided in FIG. 19C, the support arm 1701 may be pivotally coupled to the walker, treadmill, or body weight support system for rotation up and down or pitch rotations. As shown in the back view provided in FIG. 19D, the support arm 1701 may be pivotally coupled for lateral rotations or rolling as well. As shown in the top view provided in FIG. 19E, the lateral front support bar 1702 may be configured for yaw rotations.

As utilized herein, the terms "approximately," "about," "substantially" and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described without restricting the scope of these features to the precise numerical ranges provided. Accordingly, these terms should be interpreted as indicating that insubstantial or inconsequential modifications or alterations of the subject matter described and are considered to be within the scope of the disclosure.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

For the purpose of this disclosure, the term "coupled" means the joining of two members directly or indirectly to one another. Such joining may be stationary or moveable in nature. Such joining may be achieved with the two members or the two members and any additional intermediate members being integrally formed as a single unitary body with one another or with the two members or the two members and any additional intermediate members being attached to one another. Such joining may be permanent in nature or may be removable or releasable in nature.

Any sensor described herein may include a virtual sensor that looks up values from a non-transient memory value, receives it from a data link, from an electronic input, and/or from a hardware sensor directly measuring the value or something analogous to the value.

It should be noted that the orientation of various elements may differ according to other exemplary embodiments, and that such variations are intended to be encompassed by the present disclosure. It is recognized that features of the disclosed embodiments can be incorporated into other disclosed embodiments.

It is important to note that the constructions and arrangements of spring systems or the components thereof as shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter disclosed. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present disclosure.

All literature and similar material cited in this application, including, but not limited to, patents, patent applications, articles, books, treatises, and web pages, regardless of the format of such literature and similar materials, are expressly incorporated by reference in their entirety. In the event that one or more of the incorporated literature and similar materials differs from or contradicts this application, including but not limited to defined terms, term usage, describes techniques, or the like, this application controls.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

Also, the technology described herein may be embodied as a method, of which at least one example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The claims should not be read as limited to the described order or elements unless stated to that effect. It should be understood that various changes in form and detail may be made by one of ordinary skill in the art without departing from the spirit and scope of the appended claims. All embodiments that come within the spirit and scope of the following claims and equivalents thereto are claimed.

The invention claimed is:

1. A gait training system comprising:

a base support frame;

a hip flexion actuation assembly movably coupled to the base support frame, the hip flexion assembly comprising:

a hip flexion actuator, and a hip flexion linkage movably coupled to the hip flexion actuator for linear actuation;

a knee flexion actuation assembly movably coupled to the base support frame so as to move with respect to the base support frame independent of the hip flexion actuation assembly, the knee flexion actuation assembly comprising:

a knee flexion actuator, and a knee flexion linkage movably coupled to the knee flexion actuator for linear actuation;

a gait deviation module configured to determine a difference between a model gait and an input gait received via the hip flexion linkage and the knee flexion linkage; and a gait actuator controller communicably coupled to the gait deviation module, the hip flexion actuator, and the knee flexion actuator; the gait actuator controller configured to activate one or more of the hip flexion actuator and the knee flexion actuator in response to the difference between the model gait and the input gait to compensate for the difference between the model gait and the input gait by linear actuation of one or more of the hip flexion linkage and the knee flexion linkage.

2. The gait training system of claim 1, wherein the hip flexion actuator includes a first rotary motor coupled to a first capstan drum and wherein the knee flexion actuator includes a second rotary motor coupled to a second capstan drum.

3. The gait training system of claim 1, further comprising a first cable coupling the first capstan drum to the hip flexion linkage and a second cable coupling the second capstan drum to the knee flexion linkage.

4. The gait training system of claim 1, wherein the knee flexion linkage is movably coupled to the knee flexion actuator via a first series elastic assembly, the first series elastic assembly including at least one first spring positioned between the knee flexion actuator and the knee flexion linkage and wherein the hip flexion linkage is movably coupled to the hip flexion actuator via a second series elastic assembly, the second series elastic assembly including at least one second spring positioned between the hip flexion actuator and the hip flexion linkage.

5. The gait training system of claim 4, wherein the gait deviation module is configured to determine the difference based on a deflection of at least one of the at least one first spring and the at least one second spring.

6. The gait training system of claim 4, wherein the first series elastic assembly includes a distal spring coupled to distal end of the knee flexion linkage and a proximal spring coupled to a proximal end of the knee flexion linkage, the distal spring and the proximal spring coupled to a cable wrapped about the second capstan drum.

7. The gait training system of claim 4, wherein the first series elastic assembly includes a first spring and a second spring coupled to the knee flexion linkage, the first spring coupled to a pulley component by a first cable the second spring coupled to a second cable coupled to a leg brace.

8. The gait training system of claim 1, wherein the difference includes a position value corresponding to a position and a velocity value corresponding to a velocity.

9. The gait training system of claim 1, wherein the gait deviation module is configured to determine the difference by an impedance measurement value.

10. The gait training system of claim 1, wherein the knee flexion actuation assembly is rotatably coupled to the base support frame and wherein the hip flexion actuation assembly is rotatably coupled to the base support frame independent of the knee flexion actuation assembly.

11. The gait training system of claim 1, wherein the knee flexion actuation assembly is rotatably coupled to the base support frame via a turntable.

12. The gait training system of claim 1, wherein the knee flexion actuation assembly includes an alignment bracket comprising a plurality of rollers, the knee flexion linkage extending between the plurality of rollers.

13. The gait training system of claim 1, wherein the hip flexion actuation assembly is movably coupled to the base support frame for yaw rotation with respect to the base support frame and for pitch rotation with respect to the base support frame.

14. The gait training system of claim 1, wherein the hip flexion linkage and the knee flexion linkage are coupled to a brace configured for attachment below the knee.

15. The gait training system of claim 1, wherein the hip flexion linkage includes a brace coupling configured to rotate about a plurality of axes, the brace coupling coupling the hip flexion linkage to a knee brace.

16. The gait training system of claim 1, wherein the base frame includes a walker.

17. The gait training system of claim 1, wherein the base frame includes a treadmill.

18. A gait training method comprising:

receiving, at a gait training controller, model gait values corresponding to parameters of a model gait;

detecting, via at least one sensor communicably coupled to the gait training controller, parameters of an input gait received via a knee flexion linkage coupled to a knee flexion actuator and a hip flexion linkage coupled to a hip flexion actuator, the knee flexion linkage coupled to the knee flexion actuator via a first series elastic assembly including at least one first spring, the hip flexion linkage coupled to the hip flexion actuator via a second series elastic assembly including at least one second spring;

determining a difference between the model gait and the input gait; and activating one or more of the knee flexion actuator and the hip flexion actuator so as to compensate for the difference between the model gait and the input gait.

19. The gait training method of claim 18, wherein detecting comprises sensing a change in a position of the knee flexion linkage and the hip flexion linkage.

20. The gait training method of claim 19, wherein determining a difference between the model gait and the input gait further comprises determining a force being applied to at least one of the at least one first spring and the at least one second spring.

21. The gait training method of claim 19, wherein activating one or more of the knee flexion actuator and the hip flexion actuator comprises rotating a capstan drum.

22. A gait training system comprising:

a base support frame;

an upper flexion actuation assembly movably coupled to the base support frame, the upper flexion assembly comprising:

a first flexion actuator, and a first flexion linkage movably coupled to the first flexion actuator for linear actuation;

a lower flexion actuation assembly movably coupled to the base support frame so as to move with respect to the base support frame independent of the upper flexion actuation assembly, the lower flexion actuation assembly comprising:

a second flexion actuator, and a second flexion linkage movably coupled to the second flexion actuator for linear actuation;

a leg brace coupled to the first flexion linkage the second flexion linkage by one or more series elastic assemblies, the one or more series elastic assemblies including at least one spring component;

a gait deviation module configured to determine a difference between a model gait and an input gait received via the upper flexion linkage and the lower flexion linkage; and a gait actuator controller communicably coupled to the gait deviation module, the upper flexion actuator, and the lower flexion actuator; the gait actuator controller configured to activate one or more of the first flexion actuator and the second flexion actuator in response to the difference between the model gait and the input gait to compensate for the difference between the model gait and the input gait by linear actuation of one or more of the first flexion linkage and the second flexion linkage via the leg brace.

* * * * *